United States Patent [19]

Boynton et al.

[11] 4,144,728

[45] Mar. 20, 1979

[54] SKI LOCK

[76] Inventors: Rudy C. Boynton, 517 Davenport Ct., Sunnyvale, Calif. 94087; Ronald A. Witherspoon, 20151 Cherry La., Saratoga, Calif. 95070

[21] Appl. No.: 894,667

[22] Filed: Apr. 10, 1978

[51] Int. Cl.[2] ..... E05B 73/00

[52] U.S. Cl. ..... 70/58; 280/11.37 A

[58] Field of Search ..... 70/14, 18, 19, 57, 58; 211/60 SK; 280/11.37 E, 11.37 A, 11.37 K, 11.37 C; 24/81 SK, 73 SG

[56] References Cited

U.S. PATENT DOCUMENTS

| | | | |
|---|---|---|---|
| 3,429,152 | 2/1969 | Whitaker | 70/58 |
| 3,962,893 | 6/1976 | Anderson | 70/19 |
| 4,057,983 | 11/1977 | Morgan | 70/18 |

*Primary Examiner*—Robert L. Wolfe

*Attorney, Agent, or Firm*—Townsend and Townsend

[57] ABSTRACT

A device for locking skis in a crossed relationship. A pair of elongated, flat ski engageable members are hinged together at adjacent ends for relative movement into and out of operative positions in which the members are longitudinally aligned with each other. A central triangular wedge is mounted rigidly to one of the flat members. An inwardly facing U-shaped channel at the outer end of each of the flat members receives one side edge margin of a respective ski. The other side edge margin of the ski engages and is held against the adjacent side face of the central triangular wedge. A lock plate carried by the triangular wedge is movable into overlapping relationship to the side faces of the wedge to form channels near the zone of hinging to capture the other side edge margins of the ski to thereby secure the skis to the device. The members can be moved out of their operative positions and into side-by-side relationship to make the device sufficiently compact to fit easily into a garment pocket.

8 Claims, 5 Drawing Figures

100
94
96
90
92
98
80
106
104
102
84
110
112
30
37
32

40'
48'
49'

50
12
54
58
25
52
17
15
20
94
106
22
40
115
44
10
49
19
42
48
50
12
40
10

SKI LOCK

BACKGROUND OF THE INVENTION

As skis have become more expensive and sophisticated, their attractiveness to thieves has become correspondingly greater. Moreover, as skiing has become increasingly popular and ski resorts have become increasingly crowded, the opportunities to steal skis have increased. While ski resorts typically provide their patrons with locking racks for their skis, these racks are often too few in number for the people wanting to use them. Moreover, there is normally a small charge made for using such a rack, a charge which many skiers are reluctant or unwilling to pay.

Many skiers carry their own lock and cable to secure their skis to a fixed object when it is desired to leave the skis unattended. However, it is not always possible to find a suitable fixed object to which the skier can lock his skis. Thus the skier is often forced to merely lock his skis together, unattached to any fixed object. This is unlikely to deter a ski thief, since all the thief need do is pick up the pair of skis and carry them to a location where the cable and/or lock can be removed as by cutting.

One way around this problem is to have the skis locked together in a crossed relationship. It is extremely awkward for a person to carry a pair of skis locked together in this fashion. While the owner would normally unlock such crossed skis before carrying them away, the would-be thief would be forced to carry the skis away in their crossed condition. This would draw attention to the thief, since it is unlikely that the true owner of the skis would carry them locked together like that. In this way, ski thieves become more easily recognized to security guards and other skiers. In many cases, the very fact that the skis are locked together in a crossed relationship is sufficient to deter the thief entirely.

Prior devices have been used in the past for maintaining a pair of skis in a crossed relationship. One class of such ski locks makes use of structures permanently attached to the skis themselves. U.S. Pat. No. 3,277,676 discloses a pair of engageable members, each of which is permanently mounted on its respective ski. The members, once engaged may be locked together, typically by means of a small padlock. U.S. Pat. No. 3,966,219 and No. 3,967,476, disclose permanently mounted structures on skis. U.S. Pat. No. 3,412,585 discloses a ski locking device wherein a separate cylinder engages members recessed into the skis themselves to provide the required locking action. U.S. Pat. No. 3,461,696 discloses a permanently mounted device making use of one or more protruding shafts, the alignment of which determines the angle at which the skis cross.

Ski locks requiring a member permanently mounted on a pair of skis suffer from certain disadvantages. First, the owner of several pairs of skis is forced to outfit all his skis with such ski locks. Second, as skis get shorter and bindings more sophisticated, there is less room near the central region of the ski for such a permanently mounted ski lock. Moreover, an additional device mounted to the ski may even cause weakening of the ski itself. Third, devices mounted on the ski are subject to being damaged when the skis cross or are otherwise banged around. Moreover, locking members permanently mounted to the skis themselves can get jammed with snow and ice, thereby making them difficult to operate and lock the skis together.

Other prior devices are completely removable from the skis when not in use, thereby avoiding the above problems. U.S. Pat. No. 3,429,152 dicloses separate channel-like brackets which fit around the skis and are held together by a lock and stud arrangement. An alternate embodiment uses paired T-shaped members and three studs to hold the skis locked in a crossed position. U.S. Pat. No. 3,461,696 also discloses crossed, relatively rotatable bracket-like members to hold the skis in the crossed configuration, in a manner similar to that of U.S. Pat. No. 3,429,152. U.S. Pat. No. 3,894,414 and U.S. Pat. 3,962,893 disclose ski locks that are basically nothing but clamps.

These ski locks, while avoiding the problems inherent in the ski mounted type, have their own problems. In particular, they tend to be somewhat bulky when not on the skis. Moreover, some of these devices cannot be secured to only one ski, requiring that both skis be locked. This is disadvantageous under those circumstances where the user wishes to use the lock to secure one ski to a fixed object with an additional cable while taking the other ski with him for repair or the like.

SUMMARY OF THE INVENTION

The present invention provides an improved ski lock for maintaining a pair of skis in crossed relationship. The ski lock, being completely detachable from the skis when not in use, includes a pair of hingedly interconnected plates or members adapted to confront adjacent flat surfaces of respective skis. A triangular wedge carried by one of the ski surfaces has a pair of convergent faces defining the angle at which the skis cross when locked together. Channel members at the outer ends of the plates have faces parallel to respective faces of the wedge and serve to capture the adjacent side edges of skis to hold them in a crossed condition. A small plate, larger than the wedge overlies the wedge and the adjacent side marginal edges of both skis thereby capturing the skis and holding them in the crossed condition. This plate is locked to the wedge by any desired locking arrangement. When not in use, the two ski confronting plates are swung from their end-to-end positions to side-by-side positions resulting in a compact unit which may be carried in the user's pocket.

DESCRIPTION OF THE PREFERRED EMBODIMENT

Figures 1, 2, 3:
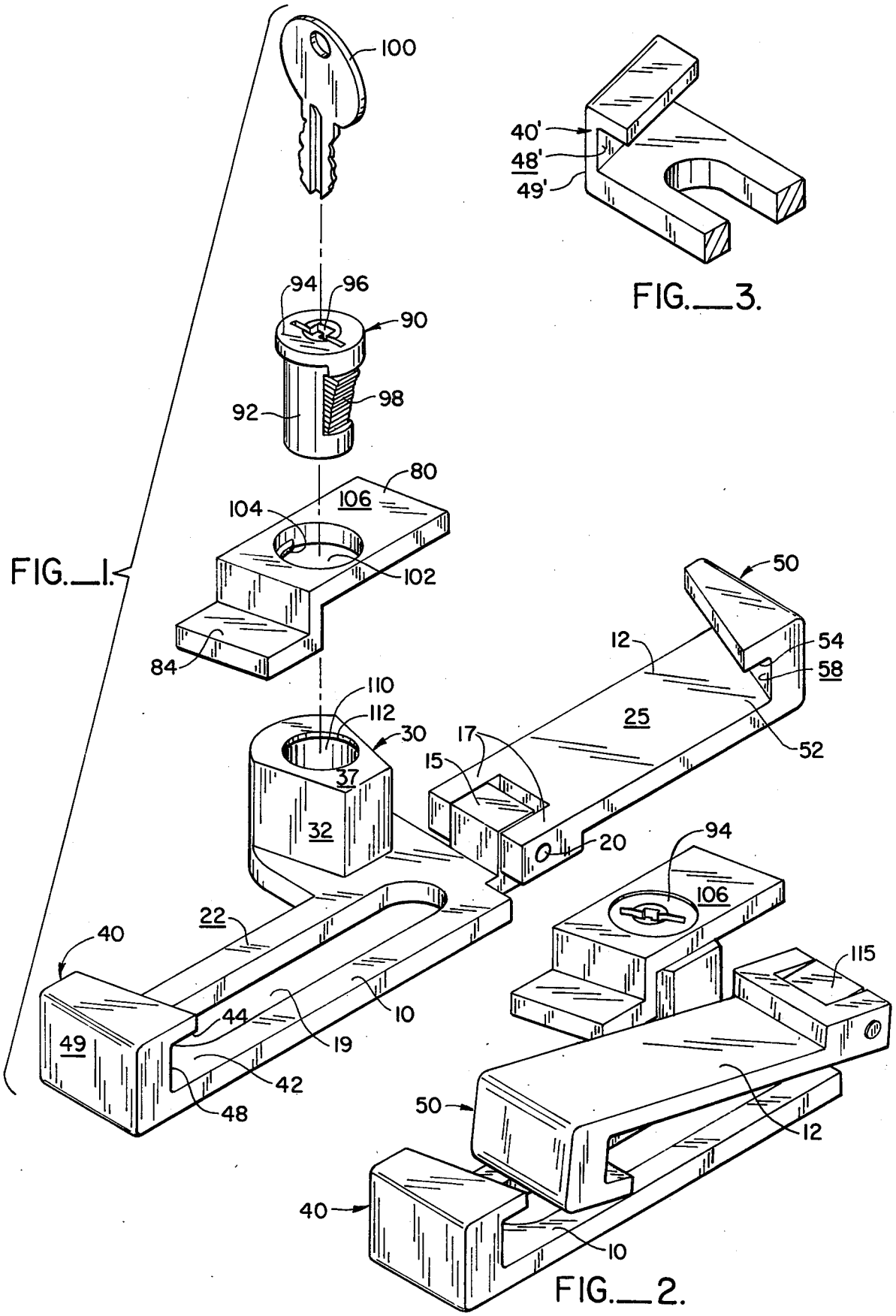
FIG. 1 is an exploded perspective view of one embodiment of the invention in its unfolded, operative position.
FIG. 2 is a perspective view of the invention folded to present a compact unit suitable for carrying in a pocket.
FIG. 3 is a fragmentary perspective view of an alternate channel configuration for each of a pair of members thereof.

In FIG. 1, an improved ski lock is shown in a position adapted to receive a pair of crossed skis. Broadly, the ski lock comprises a first elongate flat member 10 and a second elongate flat member 12. In the operative position of FIG. 1, flat members 10 and 12 are in longitudinal alignment with each other. Flat members 10 and 12 have portions 15 and 17 at their adjacent ends which cooperate with a hinge pin 20 to define a hinge coupling. The hinged coupling permits the ski lock to assume a folded condition, shown in FIG. 2, wherein members 10 and 12 are brought into a substantially side-by-side relationship, thereby making the ski lock sufficiently compact to easily fit into a garment pocket. Flat member 10 preferably has elongate recess 19 for reduced weight. Flat member 12 could be similarly recessed, if desired.

Flat members 10 and 12 have respective flat surfaces 22 and 25, each adapted to confront a surface of a ski. When the ski lock is in its extended operative position, ski-confronting surfaces 22 and 25 are substantially parallel but are in different planes, the hinged coupling being configured to space surface 25 from surface 22 by a distance corresponding to the thickness of one of the skis to be secured.

Flat member 10 has a wedge 30 secured thereto, member 30 extending outwardly upwardly from surface 22 and located near hinge-defining portion 15. Wedge 30 has first and second relatively convergent surfaces 32 and 35 perpendicular to surface 22, the angle between surfaces 32 and 35 defining the angle at which the skis are to be held relative to one another in a crossed condition. Wedge 30 has upper, flat surface 37 parallel to surface 22 of flat member 10, and spaced from surface 22 by a distance corresponding to the total thickness of the pair of skis to be secured. Thus, since surface 25 is spaced from surface 22 by a distance corresponding to the thickness of one of the skis, surface 37 is one ski thickness above surface 25.

Flat members 10 and 12 have respective L-shaped members 40 and 50, respectively, at their outer ends, members 40 and 50 cooperating with members 10 and 12 to form a pair of U-shaped channels 42 and 52, respectively. Members 40 and 50 have surfaces 44 and 54 respectively, which are parallel with surfaces 22 and 25. Also, members 40 and 50 have surfaces 48 and 58, respectively, which are generally perpendicular to surface 22, surface 48 being parallel to surface 32 of wedge 30, and surface 58 being parallel to surface 35 wedge 30. The distance between surfaces 32 and 48 is equal to the width of one of the skis. Similarly, the distance between surfaces 35 and 58 is equal to the width of the other ski.

Since surfaces 48 and 58 are equidistant from surfaces 32 and 35 of wedge 30, and since wedge 30 is carried on flat member 10, it is apparent that flat member 12 is shorter than flat member 10. Thus, when the improved ski lock is folded, as shown in FIG. 2, L-shaped member 50 confronts flat portion 10 without interference from L-shaped member 40.

FIG. 3 shows an alternate embodiment of L-shaped member 40, it being understood that L-shaped member 50 could also be made in the same way. In the embodiment of FIG. 1, L-shaped member 40 has a outer vertical surface 49 which is angularly disposed relative to surface 48 by an angle equal to half the angle between surfaces 32 and 35. In the embodiment of FIG. 3, L-shaped member 40' has its outermost surface 49' parallel to inwardly facing surface 48'.

Figure 4:
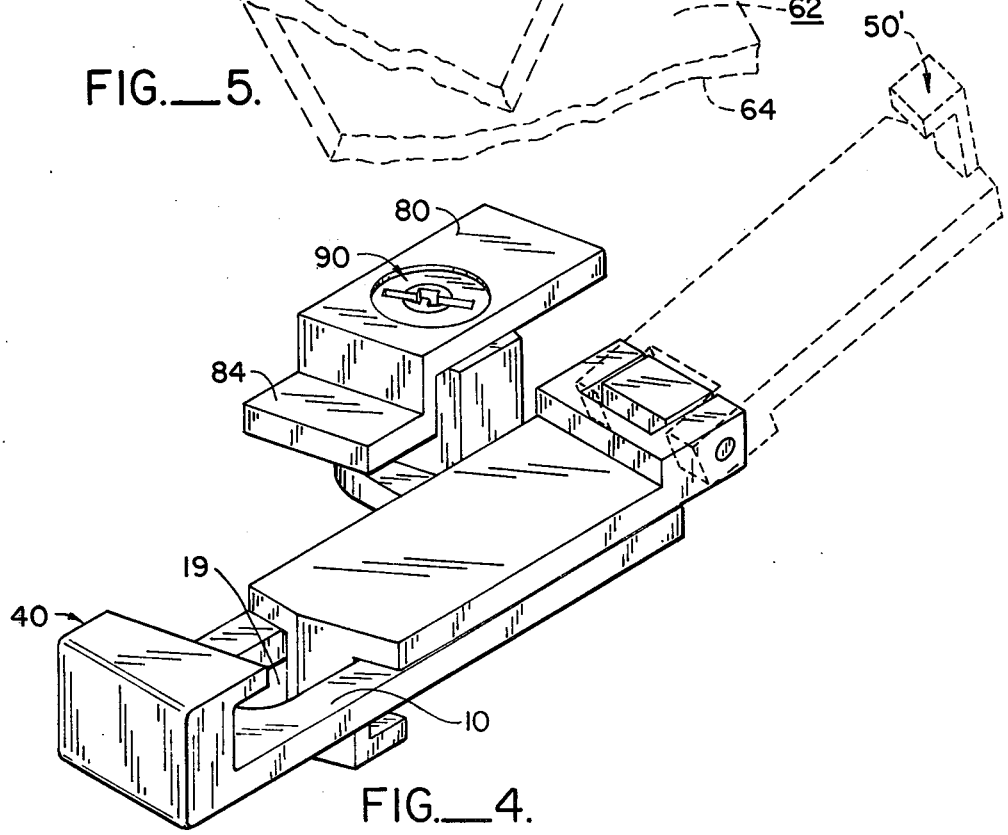
FIG. 4 is a perspective view of an alternate embodiment of the invention in a folded position with the unfolded position shown in phantom.

FIG. 4 shows an alternate configuration for L-shaped member 50 which allows the ski lock to be folded in an especially compact fashion. In this configuration, L-shaped member 50' is narrower than the width of recess 19 in flat member 10, and passes therethrough when the device is folded.

Figure 5:
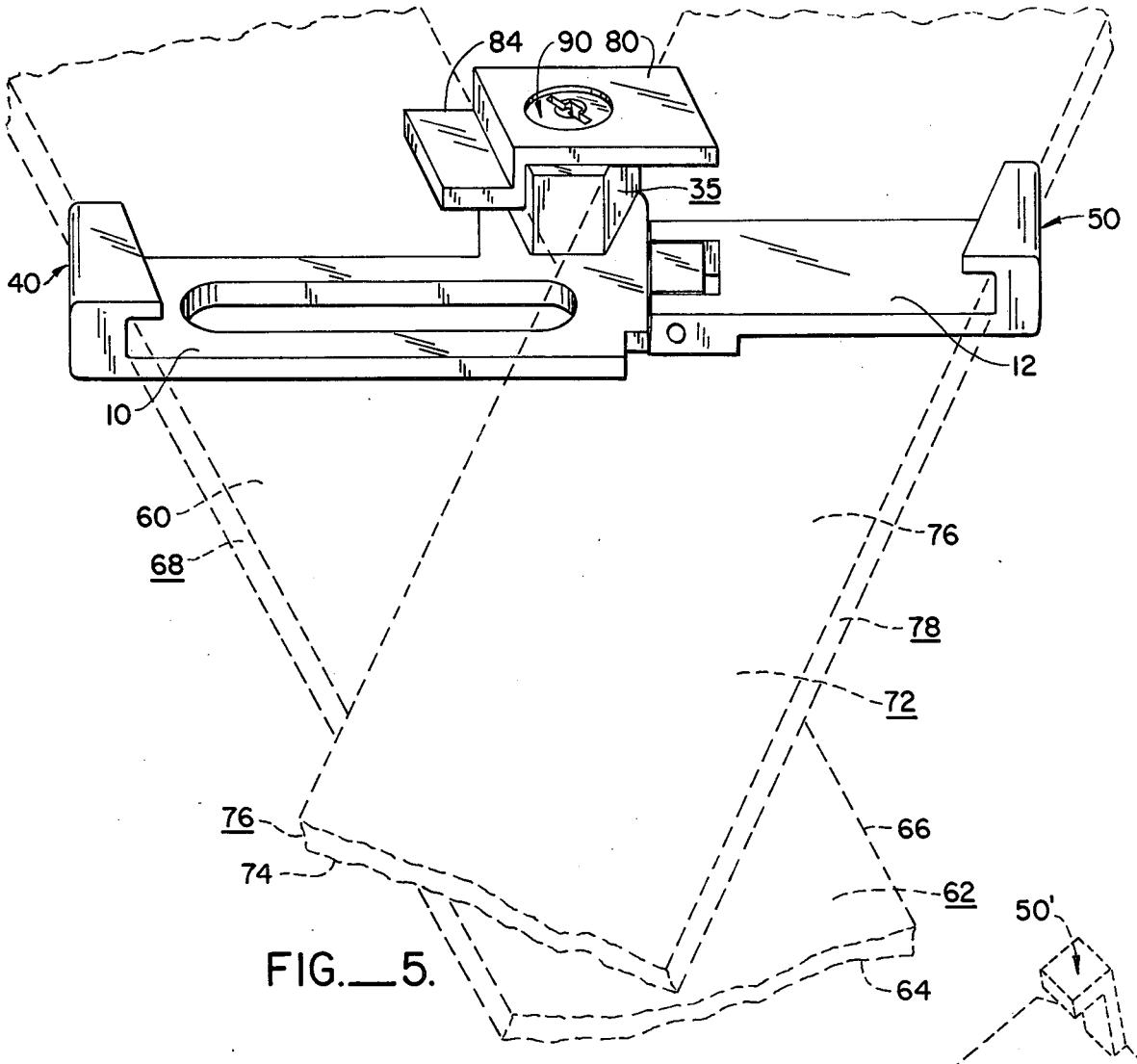
FIG. 5 is a perspective view showing a pair of skis (in phantom) held in a crossed relationship by the present invention.

With reference to FIG. 5, the placement and securing of a pair of skis by the improved ski lock can be understood. A first ski 60 has first and second opposed, generally flat surfaces 62 and 64, and opposed, generally flat side faces 66 and 68. Ski 60 is placed with surface 64 confronting surface 22 of flat member 10 such that side face edge 68 is captured within channel 42. The spacing of channel 42 from wedge 30 insures that opposed side face 66 lies along surface 32 of wedge 30. Since surface 25 is spaced from surface 22 by the thickness of one ski, surface 25 of flat member 12 and surface 62 of ski 60 will be substantially flush. Ski 70, having opposed, generally flat surfaces 72 and 74, and, generally flat opposed side faces 76 and 78 is then placed with surface 74 confronting surface 25 of flat member 12 and also confronting a portion of surface 62 of ski 60. Side face 78 is received within channel 52, and the spacing of channel 52 from wedge 30 insures that side face 76 of ski 60 extends along and is generally contiguous to surface 35. Since surface 37 of wedge 30 is two ski thicknesses above surface 22, and one ski thickness above surface 25, surface 72 of ski 70, and surface 37 of wedge 30, will be substantially flush when the skis are in the dashed line positions of FIG. 5.

The skis, once coupled to the ski lock as shown in FIG. 5, are secured against outward movement from member 10 and 12 by lock plate 80 which overlies surface 37 of wedge 30. Plate 80 extends beyond surface 35 to overlap a part of surface 72 of ski 70, thereby preventing outward movement of that ski relative to member 12. Lock plate 80 has a portion 84 that extends beyond surface 32 of wedge 30 and extends below surface 37 by one ski thickness. Since surface 37 is one ski thickness above surface 62 of ski 60, portion 84 of lock plate 80 confronts or overlaps a part of surface 62 of ski 60.

Lock plate 80 may be secured to wedge 30 by any conventional locking apparatus. In the interest of compactness, a wafer lock 90 of standard manufacture is used. Referring again to FIG. 1, lock 90 has a cylindrical body portion 92 and a larger diameter head portion 94 having keyhole 96. A plurality of wafers 98 are spring-loaded to extend beyond the outer surface of cylindrical body portion 92. Insertion of key 100 into keyhole 96 aligns the wafers so that they are flush with the outer surface of body portion 92. Lock body 92 passes through lock plate aperture 102, the diameter of which is that of head portion 94. Annular ridge 104 extends inwardly to prevent head 94 from passing through aperture 102, thereby allowing lock head 94 to hold lock plate 80 against outward movement. Ridge 104 need not extend the entire circumference of aperture 102. The top of lock head 94 is preferably held flush with top surface 106 of lock plate 80 as shown in FIG. 2 when wafer lock 90 is inserted through aperture 102.

Wedge 30 has bore 110 having a diameter greater than that of body portion 92 of wafer lock 90. Annular ridge 112 adjacent surface 37 restricts the diameter of the opening to that of body portion 92. In the locking position, plate 80 is placed over surface 37 of wedge 30 with aperture 102 aligned with bore 110. When the key is removed, the wafers 98 protrude and are captured behind annular ridge 112, thereby securing lock plate 80 to wedge 30.

With the exception of lock 90, key 100, and hinge pin 20, the latter being made of steel, the improved ski lock is preferably constructed of extruded aluminum. When not in use, the ski lock can be folded into the position shown in FIG. 2 or FIG. 4 and carried in a garment pocket.

We claim:

1. A device for maintaining a pair of skis in a crossed overlying relationship to each other at a predetermined angle comprising: a wedge-shaped member having first and second, relatively convergent surfaces at said predetermined angle relative to each other, said surfaces adapted to abut, respectively, a first side margin of the first of said pair of skis and a first side margin of the second of said pair of skis; means coupled to said member for preventing lateral movement of said first side margins of said first and second skis in a first direction away from said member; means spaced from said member for preventing movement of said first side margins of said first and said second skis in a second direction perpendicular to the first direction; a plate removably carried by said member and extending laterally beyond said first and second surfaces, whereby said plate overlies said first side margins of said first and second skis when the skis are in crossed positions relative to each other and when the first side margins of the skis extend along and are generally contiguous to respective surfaces of the member; and means coupled with the plate for releasably locking said plate to said member with said first side.

2. The device of claim 1 wherein said means for preventing movement of said first side margins in said second direction comprises a channel member adapted for receiving the second side margin of each ski, respectively.

3. A device for maintaining a pair of skis in crossed relationship comprising: a first elongated member having a flat surface adapted to engage a surface of the first of said pair of skis; a second elongated member having a flat surface adapted to engage a surface of the second of said pair of skis; attachment means pivotally interconnecting adjacent ends of said first and second members; a first channel member attached to the outer end of said first member and adapted to receive one side edge of the corresponding ski when said ski engages said surface of said first member; a second channel member attached to the outer end of said second member and adapted to receive one side edge of said second ski when said second ski engages said surface on said second member; a wedge-shaped member carried by and extending laterally from said flat surface on said first member, said wedge-shaped member having a pair of relatively convergent side faces for engaging the opposite side edges of said first ski and said second ski, respectively, when said first side edges of said first and second skis respectively are received within said first and second channel members; a plate carried by said wedge-shaped member and having a length sufficient to permit it to overlie the opposite side edges of said first and second skis, to retain them in crossed relationship to each other; and locking means for releasably maintaining said plate in said overlying relationship with said skis.

4. The device of claim 3, wherein said attachment means comprises a hinge.

5. the device of claim 3, wherein said first and second members are aluminum extrusions.

6. A device for releasably locking a pair of skis in a crossed condition comprising: a pair of elongated members, each member having a generally flat ski-engageable surface; means pivotally connecting one end of one of the members to one end of the other member to allow the members to move relative to each other from first operative positions with the members being in generally end-to-end relationship to second positions with the members being in generally side-by-side relationship; a wedge secured to a first of said members adjacent to said connecting means, said wedge having a pair of relatively convergent side surfaces substantially perpendicular to said flat surface of said first member, each side surface of the wedge generally facing toward the outer end of a respective member when the members are in said first positions; means at the outer end of each member, respectively, for forming a channel having an inner surface generally parallel with and facing the corresponding side surface of the wedge; a plate coupled with the wedge for overlapping a part of the flat surface of each member, respectively; and means coupled with the plate for releasably locking the same to the wedge.

7. A device as set forth in claim 6, wherein the plane of the flat surface of said one member is spaced laterally from the plane of the other member by a distance equal to the thickness of a ski when the members are in said first position.

8. A device as set forth in claim 6, wherein the side surfaces of the wedge extend outwardly from the flat surface of said first member by a distance equal to the combined thickness of said pair of skis.

* * * * *